US009828074B2

(12) United States Patent
Witkowski

(10) Patent No.: US 9,828,074 B2
(45) Date of Patent: Nov. 28, 2017

(54) APPARATUS FOR EQUIPPING A CANOE WITH OUTRIGGERS AND A STABLE PLATFORM

(71) Applicant: Thomas Joseph Witkowski, Bellville, OH (US)

(72) Inventor: Thomas Joseph Witkowski, Bellville, OH (US)

( * ) Notice: Subject to any disclaimer, the term of this patent is extended or adjusted under 35 U.S.C. 154(b) by 0 days.

(21) Appl. No.: 15/410,982

(22) Filed: Jan. 20, 2017

(65) Prior Publication Data

US 2017/0210448 A1 Jul. 27, 2017

Related U.S. Application Data

(60) Provisional application No. 62/281,782, filed on Jan. 22, 2016.

(51) Int. Cl.

| | |
|---|---|
| ***B63B 1/14*** | (2006.01) |
| ***B63B 7/00*** | (2006.01) |
| ***B63B 17/00*** | (2006.01) |
| ***B63B 43/14*** | (2006.01) |
| ***B63B 35/71*** | (2006.01) |
| ***B63B 3/56*** | (2006.01) |
| ***B63B 7/02*** | (2006.01) |
| ***E04H 15/02*** | (2006.01) |
| ***E04H 15/56*** | (2006.01) |
| ***E04H 15/60*** | (2006.01) |

(52) U.S. Cl.

CPC ..... *B63B 35/71* (2013.01); *B63B 1/14* (2013.01); *B63B 3/56* (2013.01); *B63B 7/02* (2013.01); *B63B 17/00* (2013.01); *B63B 43/14* (2013.01); *E04H 15/02* (2013.01); *E04H 15/56* (2013.01); *E04H 15/60* (2013.01); *B63B 2001/145* (2013.01); *B63B 2007/003* (2013.01); *B63B 2035/715* (2013.01)

(58) Field of Classification Search

CPC ..... B63B 1/14; B63B 2001/145; B63B 2003/145; B63B 3/56; B63B 2007/003; B63B 7/02; B63B 17/00; B63B 35/71; B63B 2035/715; B63B 43/14; B63B 2043/145; E04H 15/02; E04H 15/56; E04H 15/60

USPC ..... 114/123, 343, 347, 351–353, 361, 363, 114/364

See application file for complete search history.

(56) References Cited

U.S. PATENT DOCUMENTS

| | | | | |
|---|---|---|---|---|
| 289,208 | A * | 11/1883 | Besosa | B63B 39/06 114/123 |
| 652,184 | A | 6/1900 | Howell | |
| 1,342,012 | A | 6/1920 | Buch | |
| 2,472,185 | A * | 6/1949 | Apel | B63B 43/12 114/363 |
| 3,291,088 | A | 12/1966 | Klose | |
| 3,593,684 | A | 7/1971 | Cogliano | |
| 3,807,338 | A | 4/1974 | Shader | |

(Continued)

*Primary Examiner* — Ajay Vasudeva

(74) *Attorney, Agent, or Firm* — Ward Law Office LLC; Jacob M. Ward

(57) ABSTRACT

An internal canoe frame acts as a mount for retractable outriggers, foldable panels, and pontoons. With the outriggers, panels, and pontoons, the canoe can be adapted to provide a stable multi-purpose waterborne platform. In some embodiments, the platform may also include a support frame for a tent, to provide a waterborne camping site for an intrepid canoer.

12 Claims, 6 Drawing Sheets

(56) References Cited

U.S. PATENT DOCUMENTS

| | | | | | |
|---|---|---|---|---|---|
| 3,846,858 | A | | 11/1974 | Syfritt | |
| 3,896,832 | A | * | 7/1975 | Montoya | B63B 17/02 114/361 |
| 3,902,443 | A | | 9/1975 | McDougall | |
| 3,937,166 | A | | 2/1976 | Lindsay | |
| 3,940,813 | A | | 3/1976 | Konstantinov et al. | |
| 3,955,228 | A | | 5/1976 | Gaschenko et al. | |
| 4,068,611 | A | * | 1/1978 | Leather | B63H 16/06 114/363 |
| 4,082,049 | A | * | 4/1978 | Nicol | B63B 7/085 114/345 |
| 4,133,577 | A | | 1/1979 | Pilant | |
| 4,136,414 | A | | 1/1979 | Popkin | |
| 4,294,184 | A | * | 10/1981 | Heinrich | B63B 1/125 114/123 |
| 4,516,941 | A | | 5/1985 | Reid | |
| 4,621,587 | A | | 11/1986 | Pool | |
| 4,624,208 | A | * | 11/1986 | Hyne | B63B 7/085 114/345 |
| 4,641,594 | A | | 2/1987 | Birkett | |
| 4,646,669 | A | | 3/1987 | Frank | |
| 4,664,049 | A | * | 5/1987 | Mourgue | B63B 1/125 114/39.26 |
| 4,751,889 | A | | 6/1988 | Pool | |
| 4,766,830 | A | | 8/1988 | Kunz | |
| 4,807,551 | A | | 2/1989 | Ace | |
| 5,007,362 | A | | 4/1991 | Balogh | |
| 5,016,557 | A | | 5/1991 | Miller | |
| 5,228,408 | A | | 7/1993 | Jannausch | |
| 5,331,916 | A | | 7/1994 | Martin | |
| 5,524,564 | A | | 6/1996 | Porada | |
| D394,629 | S | | 5/1998 | Lincoln | |
| 6,050,210 | A | | 4/2000 | Grzybowski | |
| 6,173,671 | B1 | | 1/2001 | Casull | |
| 6,189,478 | B1 | | 2/2001 | Myers et al. | |
| 6,305,306 | B1 | | 10/2001 | Grzybowski | |
| 6,745,716 | B2 | | 6/2004 | Belyeu | |
| 7,047,902 | B1 | | 5/2006 | Little | |
| 7,165,501 | B2 | | 1/2007 | Woomer | |
| 7,171,915 | B1 | | 2/2007 | Rutan | |
| 7,182,037 | B2 | * | 2/2007 | Otobe | B63B 35/795 114/343 |
| 7,540,248 | B2 | | 6/2009 | London | |
| 7,814,854 | B2 | | 10/2010 | Jouffroy | |
| 8,047,153 | B2 | | 11/2011 | Wood | |
| 8,939,103 | B2 | * | 1/2015 | Wong | B63B 43/14 114/123 |
| 2004/0206288 | A1 | | 10/2004 | Wilcox et al. | |
| 2006/0102063 | A1 | | 5/2006 | Boelryk | |
| 2010/0050922 | A1 | | 3/2010 | Quigley | |
| 2015/0259033 | A1 | | 9/2015 | George et al. | |

* cited by examiner

APPARATUS FOR EQUIPPING A CANOE WITH OUTRIGGERS AND A STABLE PLATFORM

CROSS-REFERENCE TO RELATED APPLICATIONS

This application claims the benefit of U.S. Provisional Application No. 62/281,782, filed on Jan. 22, 2016. The entire disclosure of the above application is hereby incorporated herein by reference.

FIELD

The present disclosure relates to canoes and, more particularly, to providing a multi-purpose canoe platform for camping and the like.

BACKGROUND

For outdoor adventurers who choose to explore by water, many times there is a lack of suitable camping sites. In addition, the environmental impact of many campers on those sites that are available can stress the land. Campers may also have issues with animal invasions and the concern with human waste.

Existing canoes that have outriggers attached are typically bolted to the thwarts and do not have the ability to retract. This configuration makes it difficult for occupants of the canoe to move between the front and back ends of the canoe.

Another problem with current canoe outriggers, is that the wide berth of the outriggers limits the canoer's ability to paddle into narrow water.

There is a continuing need for a canoe that is configurable to provide a multi-purpose platform, which may be used for an on-water campground.

SUMMARY

In concordance with the instant disclosure, a canoe that is configurable to provide a multi-purpose platform, and which may be used for an on-water campground, is surprisingly discovered.

In one embodiment, a canoe frame insert has a bulkhead support member, a gunwale support, and an outrigger bracket. The bulkhead support member is configured to conform to an interior surface of a canoe. The gunwale support extends along a longitudinal length of the canoe and is operatively coupled to the bulkhead support member. The outrigger bracket is coupled to the bulkhead support member and configured to receive a retractable outrigger assembly.

In an exemplary embodiment, the canoe frame insert has an internal frame that may be permanently attached to the canoe. The internal frame stabilizes the gunwales, allowing for the thwarts to be removed. The internal frame is made of two components: a pair of bulkheads; and gunwale supports.

The bulkheads are two U-shaped structures built to fit inside the canoe. One is positioned behind the bow seat, and the other is positioned in front of the stern seat. The bulkheads are installed 72 inches apart in the middle of the canoe. They are constructed with ¾-inch ply wood sandwiched between two sheets of 0.090 aluminum. Total thickness of each bulkhead is about 1 inch.

The gunwale supports include 2 sheets of 0.090 aluminum (90 inches×6 inches), one on each side of the canoe spanning the distance between the bulkheads. Each sheet has a 90-degree bend 9 inches in from each end, making a length of 72 inches. Each sheet is cut to fit the contour of the canoe parallel to each other. The gunwale supports may be bolted into the bulkheads. The gunwale support also has a one-inch-wide 90-degree bend along the inside edge of the 72-inch span. The distance between the gunwale supports generally must be parallel.

The canoe frame may further have attachments, which are removable and used to adapt the canoe floor long distances tripping. There are five different components: 1) panels that slide into the open end of each U-shaped bulkhead; 2) outrigger brackets that are bolted to a vertical part of the U-shaped bulkheads; 3) retractable outriggers that fit into the brackets and rotate 90 degrees to support the pontoons; 4) pontoons including floatation boards that are 75×10×3, one for each side of the canoe; and 5) center doors hinged to the gunwale supports with six bolts, forming a water tight covering between the bulkheads. Each door may have two panels that fold out forming a platform when opened of 24×75.

The panels may be made of light weight plastic cardboard, so that they float. They are sized to fit tightly into the open end of the bulkheads. When installed, the panels form a water tight barrier on each end of the center compartment of the canoe.

The outrigger brackets are made of composite material, e.g., used to make plastic lumber, which is easily molded and durable. They are each installed using three carriage bolts to the outside surface, vertically, of each bulkhead. An aluminum tube six inches long with a diameter of 1.25 inches is attached to the brackets with two U-bolts. These tubes accept the removable outriggers.

The retractable outriggers are made of 0.125 marine grade aluminum. The general shape is an elongated "L." The short leg of the "L" is attached to a twelve inch, 1.125-inch diameter aluminum tube. This tube fits into the tube attached to the bracket, allowing the outrigger to rotate. The long end of the "I" is attached to a "C" shaped bar that pivots from a midpoint around the long side of the "L." The pontoon is attached to a rotating two-inch tube bolted to the end of the "C."

The pontoons are made of extruded closed-cell polystyrene foam such as Styrofoam® coated with epoxy resin. The general dimensions are 75×10×3 inches. On each side of the pontoon a twelve-inch-long, 1-inch diameter tube Is attached at a 90-degree angle. These tubes are connected to the outriggers.

The center doors are made of 0.050 aluminum sheets that are approximately 12×75 inches. Each door is attached to one of the gunwale supports with a 72-inch-long hinge. A second panel (12×75 inch) is attached to the first panel by hinge to create a platform that lays on the outriggers to stabilize the system. When closed, the doors make a water tight compartment in the center of the canoe.

DRAWINGS

The above, as well as other advantages of the present disclosure, will become readily apparent to those skilled in the art from the following detailed description, particularly when considered in the light of the drawings described hereafter.

REFERENCE NUMBERS IN THE DRAWINGS

Figure 1A:
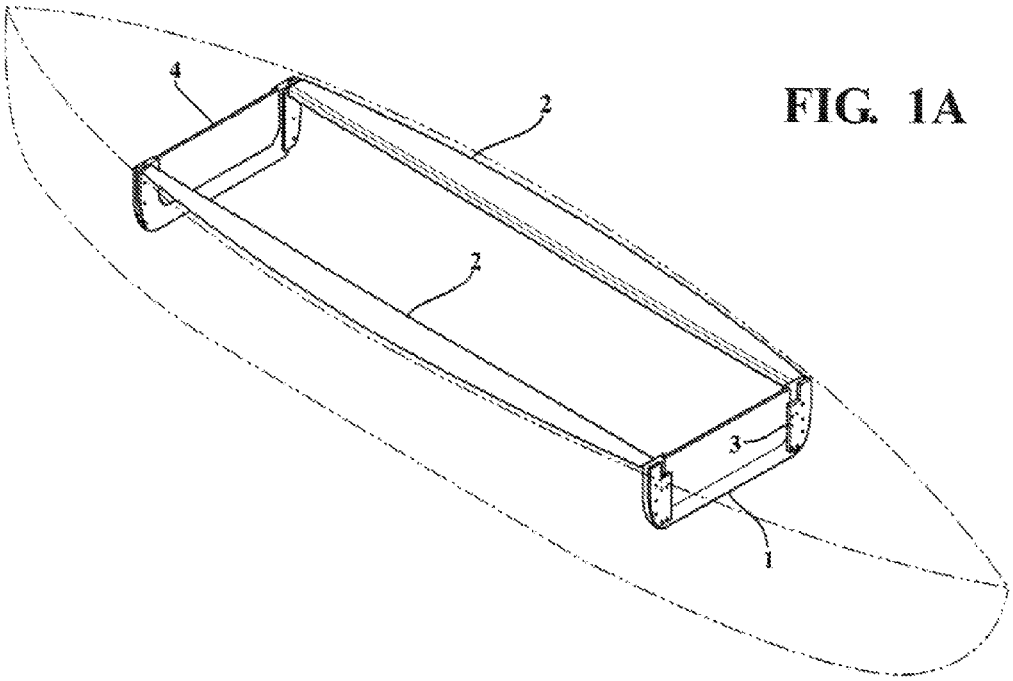
FIG. 1A is an overhead perspective view of an embodiment of an insert.

It should also be understood that throughout the drawings, corresponding reference numerals indicate like or corresponding parts and features.

1—Bulkheads;
2—Gunwale supports;
3—Outrigger brackets;
4—Panels;
5—Retractable outriggers;
5A—"L" shaped base;
5B—Extension channel;
5C—Rotating pontoon connector;
6—Pontoons;
6A—Floatation board;
6B—Pontoon supports;
7—Center doors;
7A—Inside panel;
7B—Outside panel;
7D—Horizontal tent poles; and
8—Tentage.

DETAILED DESCRIPTION

The following detailed description is of the best currently contemplated modes of carrying out exemplary embodiments of the invention. The description including the disclosure of particular dimensions or sizes is not to be taken in a limiting sense, but is made merely for the purpose of illustrating the general principles of the invention, since the scope of the invention is best defined by the appended claims.

The present disclosure includes means to convert a regular canoe into a self-contained camping site on the water. According to aspects of the present disclosure, a user can attach an insert frame member that is adapted to receive folding doors, outriggers, and pontoons that set on the canoe. When the users reach their destination they can extend the retractable outriggers, unfold the doors, and create a stable platform to camp. When the user desires to move their campsite, the doors, outriggers, and pontoons fold back into the canoe and the canoe is ready to be paddled off to the next destination.

By camping on the water, there is no environmental impact on the land areas adjacent to the waters. Moreover, camping on the water limits concerns with animal encounters, such as bears, raccoons, or mice invading the campsite.

Figure 1B:
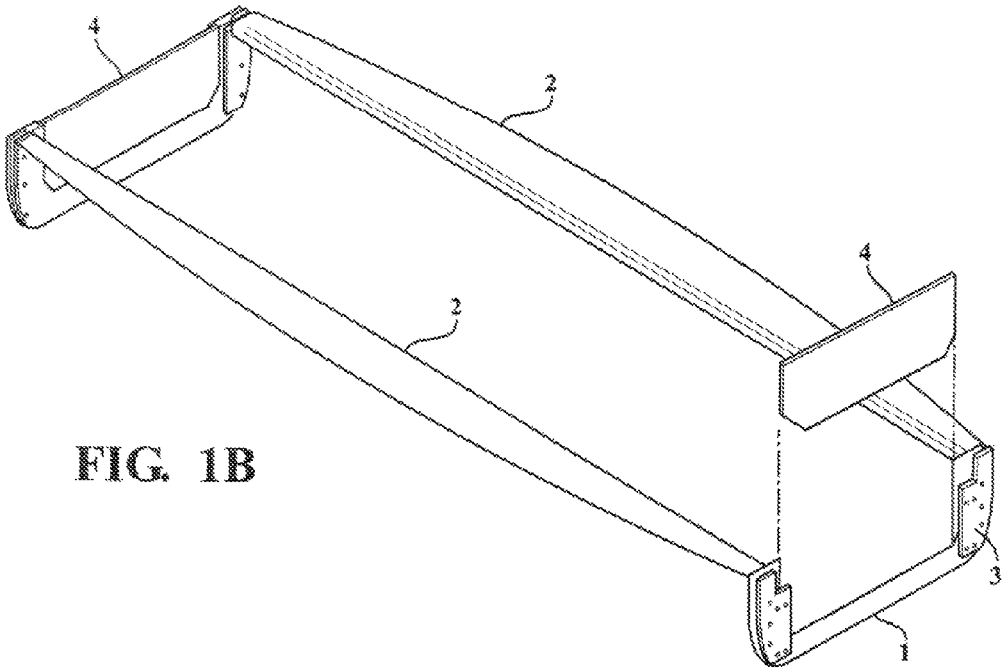
FIG. 1B is an exploded overhead perspective view of the insert shown in FIG. 1A, showing the removal of a panel from the insert.

As seen in reference to FIGS. 1A-1B, an embodiment of an insert of the present disclosure is show. The insert provides a canoe frame structure that strengthens the middle of the canoe so the thwarts can be removed. The insert is configured to be adapted to an existing canoe in order to allow conversion of a user's existing canoe to a canoe adapted to receive aspects of the disclosure. Alternatively, the insert may be incorporated with a canoe during its manufacture, and the remaining aspects of the disclosure may be added to the canoe when a user purchases the canoe, or may be added at a later date.

The insert comprises a fore and an aft bulkhead support member 1 disposed at a bottom of the insert and dimensioned to extend laterally between the interior sidewalls of the canoe. More preferably, the bulkhead support members are substantially U-shaped, and will extend between the interior sidewalls and bottom interior surface of the canoe.

A left and a right gunwale support member 2 is disposed along the gunwales of the canoe along a longitudinal length of the canoe. The gunwale support members may be attached to an existing gunwale via a fastener or may be attached to the top edge of the canoe sidewalls as an original equipment gunwale. The fasteners may include, a rivet, a screw, a bolt, an adhesive, an epoxy, or may be melded or welded, depending upon the materials selected for the skin of the canoe, including but not limited to fiberglass, metal, such as aluminum, wood, or composite material.

By way of non-limiting example, the gunwale support members may include two aluminum sheets that span the distance between the bulkheads and attach to the gunwales. The gunwale support members may be made of 0.090-gauge marine grade aluminum 90 inches long by 6 inches wide. A 90-degree bend is made 9 inches from each end. This leaves a 6×72 sheet with 9-inch bends. The outside edge should be cut to fit the contour of the canoe at the gunwales. The inside edge may have a 90-degree bend at approximately 1 inch from the edge. This bend strengthens the gunwale support and accepts the hinges that hold a center door 7.

The insert may also comprise a plurality of outrigger support brackets 3 that are secured to the bulkhead support members 1. In a non-limiting example, the insert is provided with four outrigger brackets 3 that may be made of 1-inch-thick plastic or other suitable material 13×6 inches shaped like a "D". The brackets 3 stand vertically and are secured to the bulkheads 1 via any suitable fastener. An outside edge of the outrigger mounting bracket 3 is preferably shaped to conform to the contour of the canoe sidewalls. The outrigger brackets 3 are adapted to receive and operatively attach an outrigger shaft. An inside edge of the outrigger bracket 3 may have a 6-inch-long, 1 and ⅛-inch diameter round tube bolted to it.

The insert may also comprise a fore and an aft panel 4, which may be made of plastic or other suitable material and cut to the dimensions and contour of the inside of the U shaped bulkheads. The panels 4 would be a substitute for a conventional thwart of a canoe. When installed, the panels 4 define a storage area in the space between the panels.

Figure 2A:
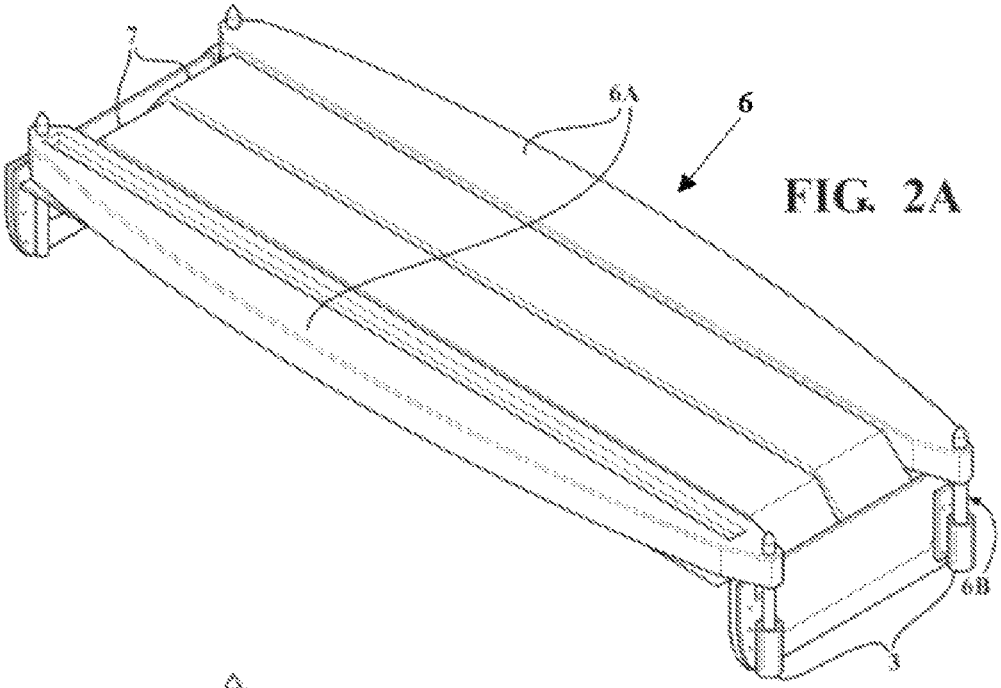
FIG. 2A is an overhead perspective view of an embodiment of an insert equipped with outriggers, pontoons, and panels, and shown in a stored position.
Figure 2B:
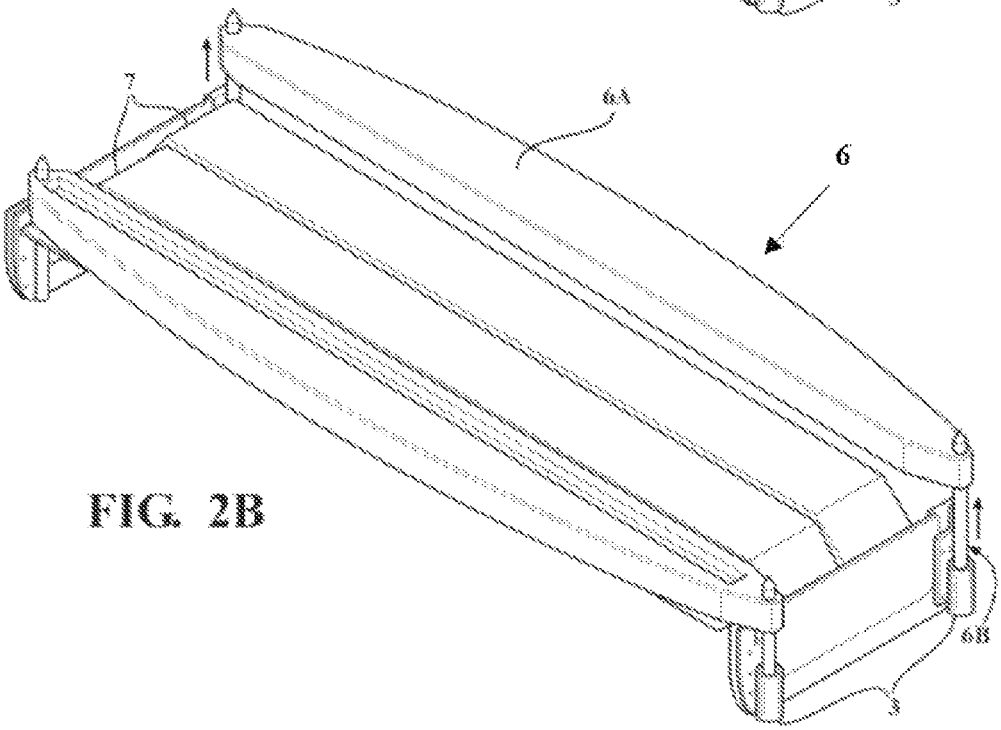
FIG. 2B is an overhead perspective view of the insert with outriggers, pontoons, and panels shown in FIG. 3, further shown in a partially deployed position.
Figure 3A:
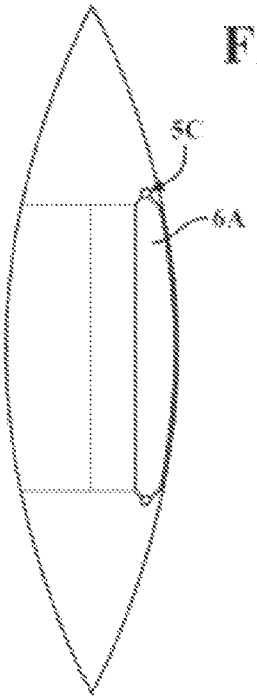
FIGS. 3A-3D are schematic top plan views of a canoe with an insert according to an embodiment of the present disclosure, and depicting a stepwise deployment of the pontoon from the insert from a stored position (FIG. 3A), through partially deployed positions (FIGS. 3B and 3C), to a fully deployed position (FIG. 3D)
Figure 3B:
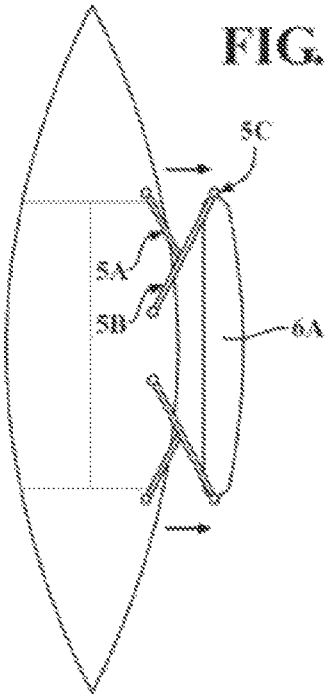
Figure 3C:
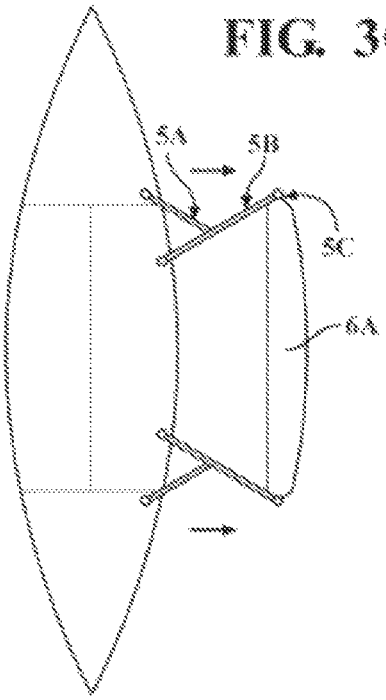
Figure 3D:
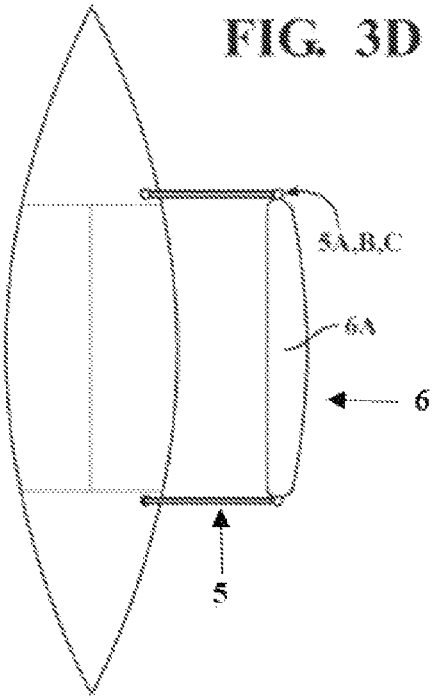

As seen in FIGS. 2A-2B, the insert may be fitted with additional components comprising other aspects of the disclosure. These components include a retractable outrigger 5, at least two pontoons 6, and a plurality of door panels 7, and in certain embodiments a tent 8. The pontoons 6 are attached to the retractable outrigger 5 and are operable between a retracted position shown in FIG. 3A and an extended position shown in FIGS. 3B-3D.

By way of non-limiting example, the four outriggers 5 may be made of 0.125-gauge marine grade aluminum. The outrigger components 5 may be generally shaped like an "L". In reference to FIGS. 3A-3B, 4, and 6, each outrigger 5 may be provided with three movable components, an L-shaped base member 5A, an extension channel 5B, and a rotating pontoon connector 5C. The L-shaped base member 5A the short base end of the L stands substantially vertically and may be formed of a round 13 inch by 1⅛-inch diameter tube. A long end of the L-shaped member 5A may be formed as a square tube 1 inch by 20 inches long. This piece lays on the gunwale support 2 and is preferably configured to rotate 90 degrees to extend to a position at generally a right angle to the center line of the canoe.

The extension channel 5B is preferably formed from a generally "C" shaped aluminum channel about 40 inches long with an inside opening of about 1⅛ inch. The extension channel 5B may be bolted at about the 20-inch mark to the long end of the L-shaped base member 5A and is adapted to rotate approximately 180 degrees around rotates 90 degrees. The rotating pontoon connector 5C may be formed by a 2-inch-long by 1 1/16-inch diameter tube that is fastened at its middle to the end of the extension channel 5B. The pontoon connector 5C rotates approximately 180 degrees and is adapted to accept the pontoon supports 6B.

The pontoons 6 may include a flotation board 6A, which is an elongate element formed from a buoyant material. The flotation board 6A may be formed from any suitable material, such as a sealed hollow plastic tube, an encased buoyant material, such as Styrofoam®, and the like. A first end of the Pontoon supports 6B are preferably attached to an end portion of the flotation board 6A and a second end of the pontoon support 6B is attached to the rotating pontoon connector 5C. The pontoon connector 5C is lockable via a removable bolt or a pin to secure the pontoon 6 in a downward position such that the pontoon 6 is placed in contact with a surface of a body of water.

The insert may also be provided with a plurality of doors 7, or panels, movable between a closed position and an open position, where in the open position the panels may be configured to form a platform surface and in the closed position, the panels 7 may be configured to define a storage area within the body of the canoe. The door 7 may include an inside panel 7A, an outside panel 78.

Figure 5:
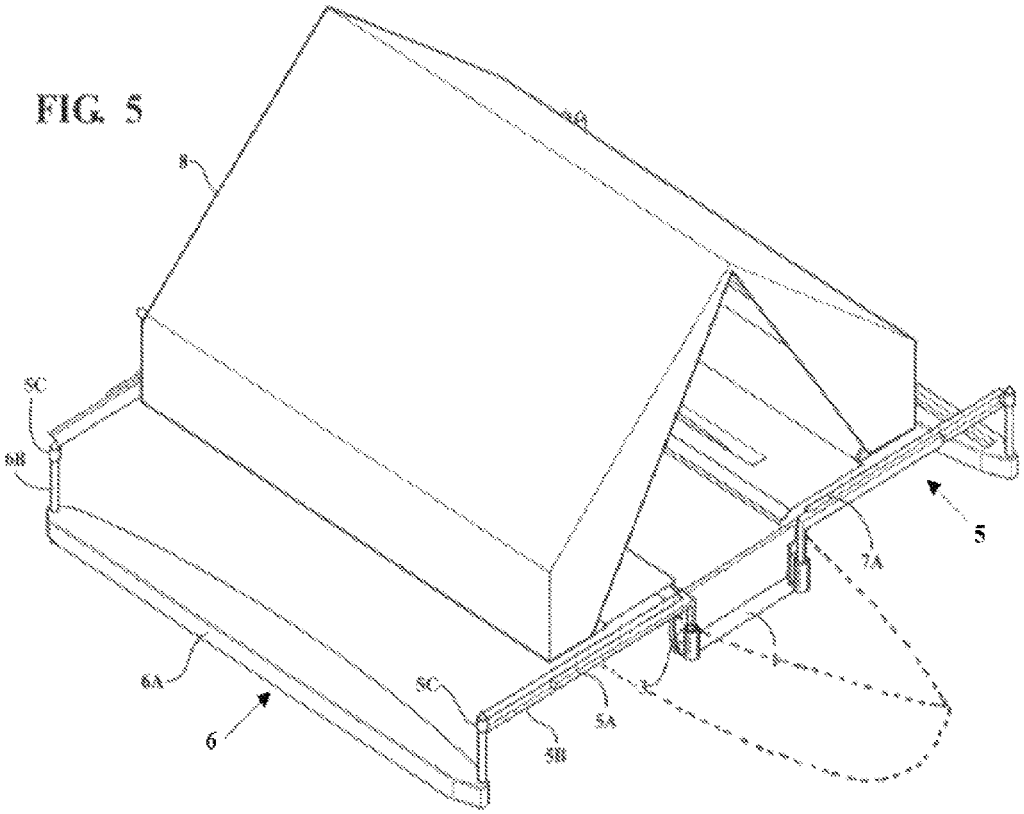
FIG. 5 is an overhead perspective view of an embodiment of the insert illustrated in FIG. 4, and shown equipped with a tent to create an on-water campsite.
Figure 6A:
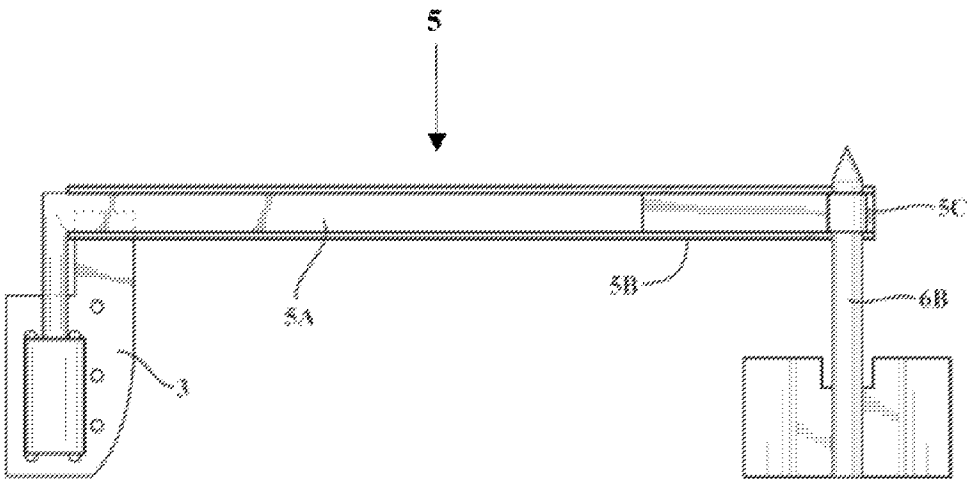
FIG. 6A is a side elevational view of a retractable outrigger, pontoon and panel for use with the insert illustrated in FIGS. 1A-5.
Figure 6B:
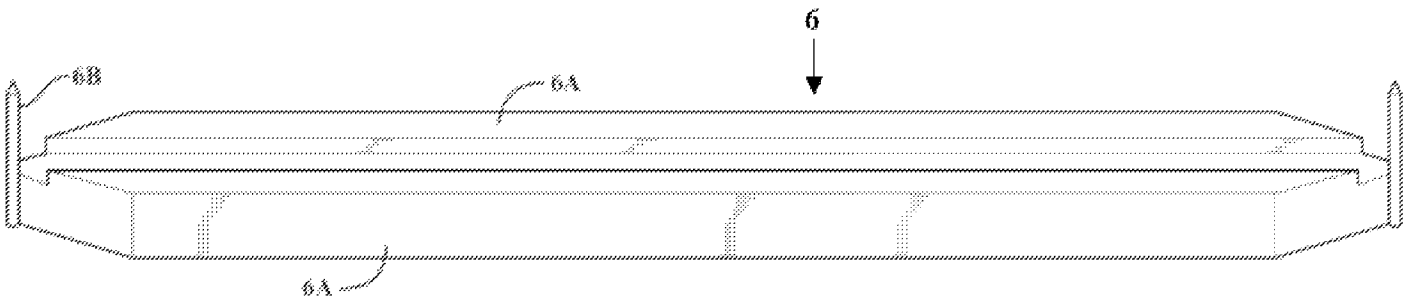
FIG. 6B is top perspective view the pontoon for use with the insert illustrated in FIGS. 1A-6A.

In certain embodiments, the panels 7 may also include a tent support upright 7C, configurable with a horizontal tent pole 7C, to provide a lower frame to support tentage 8, as seen in reference to FIG. 5. A vertical tent pole is adapted to be secured between a bottom of the canoe and a bracket to secure the vertical tent pole to the bow and stern decks of the canoe. A ridge pole is disposed between the vertical tent poles to support a ridge of the tent canvas.

With renewed reference to FIGS. 1A-6B, a method of configuring a canoe as an on-water campsite is illustrated. A canoe may be equipped with an insert of the present disclosure configured with outriggers 5, pontoons 6, panels 7, and a tent 8 in a closed configuration. In the closed configuration, the canoe is adapted for a traveling, or paddling condition. The insert and panels 7 are closed to contain the various aspects of the disclosure and may also provide a storage space for additional camping gear, food items, and other provisions as may be needed for a waterborne journey.

Figure 4:
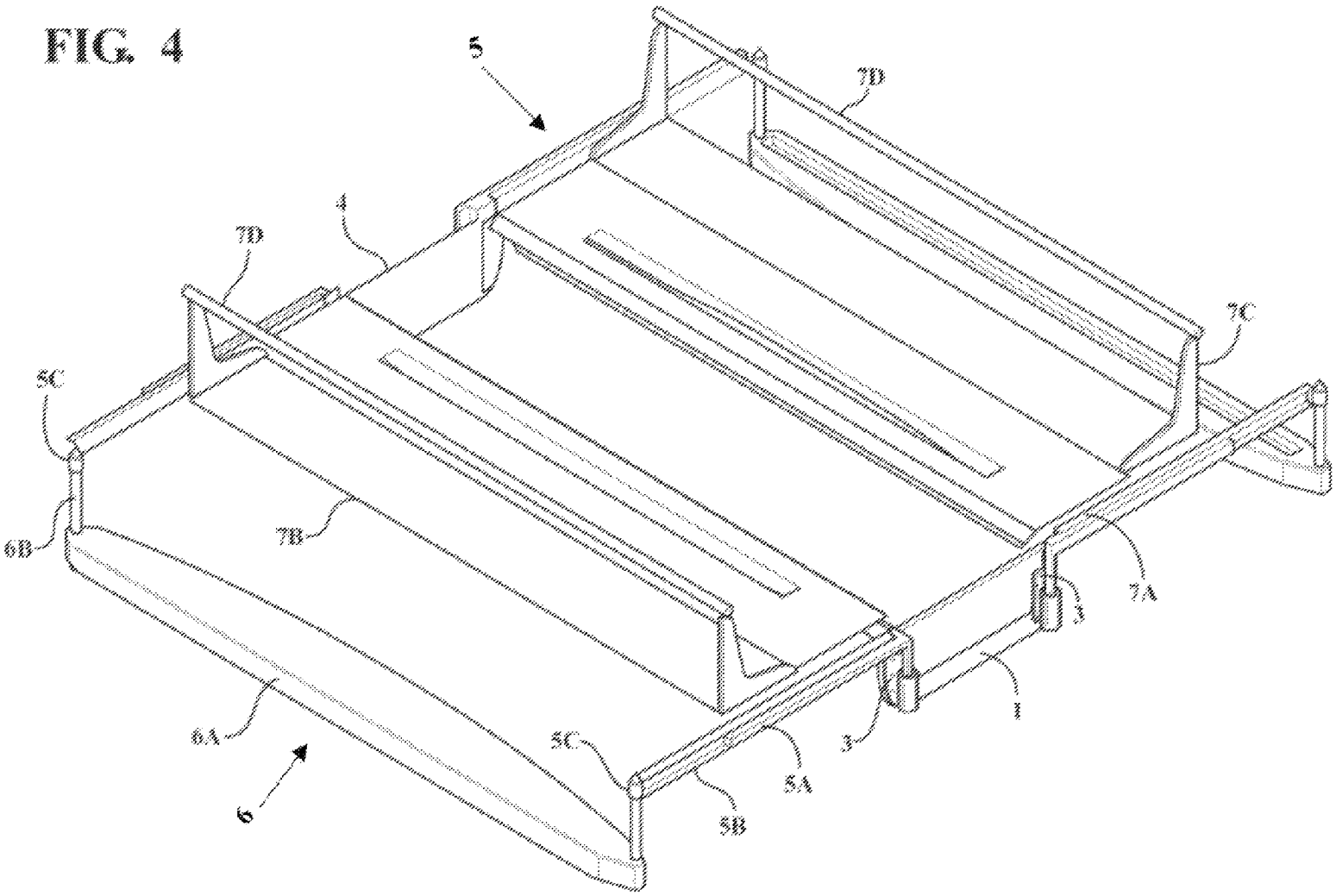
FIG. 4 is an overhead perspective view of an embodiment of the insert illustrated in FIGS. 1A-3D, and shown in a fully deployed position.

As shown in FIGS. 3A-3D, the pontoon 6 may be deployed from the stowed position, near the gunwale supports 2 of the canoe to a deployed position. The pontoon 6 is rotated outwardly and downwardly to engage with a surface of the water. In FIG. 4, the pontoons 6 are shown in an extended position after opening of inside panels 7A and pivotal displacement of the L-shaped base 5A, which is received in the channel 5B. The inside panels 7A and the outside panels 78 are opened about hinges and laid flat to define a starboard and a port platform, supported by the gunwales, the outriggers and pontoons.

In some embodiments, featuring a camping tent, continuing in reference to FIG. 5, the tent support 7C is pivoted to define the side wall frame for a tent. The tent support 7C is preferably positioned at the lateral edges of the starboard and the port platforms. It should also be appreciated that a rain tarp may be used with the canoe of the present disclosure, either alone or together with the tent as described.

A vertical tent pole is adapted to be secured between a bottom of the canoe and a bracket to secure the vertical tent pole to the bow and stern decks of the canoe. A reinforcement may be provided at the base of the canoe to disperse the point stress imparted by the vertical tent poles. A ridge pole may then be disposed between the vertical tent poles to support a ridge of the tent canvas.

In FIG. 5, the tent canvas 8 is supported by the ridge pole, preferably in the suspended or underslung orientation. Lateral sidewalls of the tent are draped over the horizontal tent poles 70 and the sides of the tent may be secured to the lateral sides of the platform, by any suitable fastener. An optional tent fly, which may further include a mosquito netting is positioned over the ridge pole and the ends secured to the bow and stern of the canoe.

Preferably, the fly is configured so as to divert rain away from the bow and stern seat openings so as to prevent the accumulation of water in the canoe during precipitation events.

As seen in reference to FIGS. 1A-6B, the multi-purpose platform provided by the brackets, outriggers, pontoons, and center doors create a stable platform for a range of user activities from their canoe, such as hunting, fishing, camping, or relaxing. In some additional embodiments, a support element may be added to facilitate the attachment and support of a mast, to quickly support the conversion of the canoe a sailboat. As will be appreciated an attachment to support a trolling motor could also be added. In some embodiments, the stern seat can be adapted with a portable latrine so that the user may contain human waste and carry it out of the environment. Additionally, the bow of the canoe can be sealed to form a water tight storage compartment. Versatility is the key to this disclosure. In addition to the foregoing, it could be adapted for scientific investigations into areas leaving no human footprint.

National Parks could increase the number of visitors with no increase in environmental impact. Water trails could be made longer without building new terrain based camping platforms or imparting additional stress on the land. Swamp areas in the south could be made more accessible. Northern campers who have issues with mosquitoes and flies do not have to go ashore where the insects thrive. The tent and rain fly can be made of camouflage material creating a blind for hunters. Scientists can use the canoe to access areas that other crafts cannot reach and still have a platform to run experiments. Due to its stability, the canoe with the insert of the present disclosure could be used in scientific experiments in shallow wetlands.

While certain representative embodiments and details have been shown for purposes of illustrating the invention, it will be apparent to those skilled in the art that various changes may be made without departing from the scope of the disclosure, which is further described in the following appended claims.

What is claimed is:

1. A canoe frame insert comprising:

a bulkhead support member configured to conform to an interior surface of a canoe;

a gunwale support extending along a longitudinal length of the canoe and operatively coupled to the bulkhead support member; and an outrigger bracket coupled to the bulkhead support member and configured to receive a retractable outrigger assembly, wherein the retractable outrigger assembly includes an L-shaped base, an extension channel, and a rotating pontoon connector, wherein the rotating pontoon connector is rotatably connected to a flotation board of a pontoon, wherein the rotating pontoon connector is connected at one end of the extension channel, and wherein one end of the L-shaped base is disposed within the extension channel, and another end of the L-shaped base is connected to the outrigger bracket.

2. The canoe frame insert of claim 1, wherein the bulkhead support member has a removable panel.

3. The canoe frame insert of claim 1, wherein the retractable outrigger assembly further includes a pontoon.

4. The canoe frame insert of claim 3, wherein the pontoon includes a floatation board that is retractably connected to the outrigger bracket with a pontoon support.

5. The canoe frame insert of claim 1, further comprising tentage.

6. The canoe frame insert of claim 5, wherein the tentage includes a main tent disposed on the canoe frame insert.

7. A canoe frame insert comprising:

a bulkhead support member configured to conform to an interior surface of a canoe;

a gunwale support extending along a longitudinal length of the canoe and operatively coupled to the bulkhead support member;

an outrigger bracket coupled to the bulkhead support member and configured to receive a retractable outrigger assembly; and a pair of center doors, wherein the center doors include inside panels that are hingedly attached to the canoe frame insert, wherein the center doors further include outside panels, and wherein the outside panels have horizontal tent poles.

8. A canoe, comprising:

a canoe body; and a canoe frame insert including a bulkhead support member conforming to an interior surface of the canoe body, a gunwale support extending along a longitudinal length of the canoe body and operatively coupled to the bulkhead support member, and an outrigger bracket coupled to the bulkhead support member and configured to receive a retractable outrigger assembly, wherein the retractable outrigger assembly includes an L-shaped base, an extension channel, and a rotating pontoon connector, wherein the rotating pontoon connector is rotatably connected to a flotation board of a pontoon, wherein the rotating pontoon connector is connected at one end of the extension channel, and wherein one end of the L-shaped base is disposed within the extension channel, and another end of the L-shaped base is connected to the outrigger bracket.

9. The canoe of claim 8, wherein the bulkhead support member has a removable panel.

10. The canoe of claim 8, further comprising tentage.

11. The canoe of claim 10, wherein the tentage includes a main tent disposed on the canoe frame insert.

12. A canoe, comprising:

a canoe body; and a canoe frame insert including a bulkhead support member conforming to an interior surface of the canoe body, a gunwale support extending along a longitudinal length of the canoe body and operatively coupled to the bulkhead support member, an outrigger bracket coupled to the bulkhead support member and configured to receive a retractable outrigger assembly, and a pair of center doors, wherein the center doors include inside panels that are hingedly attached to the canoe frame insert, wherein the center doors further include outside panels, and wherein the outside panels have horizontal tent poles.

* * * * *